US007596956B2

(12) United States Patent
Lilke

(10) Patent No.: US 7,596,956 B2
(45) Date of Patent: Oct. 6, 2009

(54) REFRIGERATED CABINET AND COOLING MODULE FOR SAME

(76) Inventor: Harvey D. Lilke, 50 Paramount Road, Winnipeg, Manitoba (CA) R2X 2W3

( * ) Notice: Subject to any disclaimer, the term of this patent is extended or adjusted under 35 U.S.C. 154(b) by 150 days.

(21) Appl. No.: 11/621,185

(22) Filed: Jan. 9, 2007

(65) Prior Publication Data

US 2008/0163628 A1 Jul. 10, 2008

(51) Int. Cl.
*F25B 21/02* (2006.01)
*F25B 21/00* (2006.01)

(52) U.S. Cl. ..... 62/3.6; 62/457.9

(58) Field of Classification Search ..... 62/3.2, 62/3.6, 457.7, 457.9, 371
See application file for complete search history.

(56) References Cited

U.S. PATENT DOCUMENTS

| | | | | |
|---|---|---|---|---|
| 4,007,600 | A | 2/1977 | Simms | |
| 4,829,771 | A | 5/1989 | Koslow et al. | |
| 5,319,937 | A * | 6/1994 | Fritsch et al. | 62/3.62 |
| 6,038,865 | A * | 3/2000 | Watanabe et al. | 62/3.6 |
| 6,173,575 | B1 | 1/2001 | Hall et al. | |
| 6,308,518 | B1 * | 10/2001 | Hunter | 62/3.3 |
| 6,354,104 | B1 * | 3/2002 | Feagin | 62/457.1 |
| 6,463,743 | B1 | 10/2002 | Laliberté | |
| 6,463,754 | B1 | 10/2002 | Matesanz | |
| 6,581,389 | B2 | 6/2003 | Rudick | |
| 6,715,298 | B2 | 4/2004 | Guo et al. | |
| 7,231,771 | B2 * | 6/2007 | McMurry et al. | 62/3.6 |

FOREIGN PATENT DOCUMENTS

| | | |
|---|---|---|
| CA | 2138370 | 1/1994 |
| CA | 2303439 | 3/1999 |
| CA | 2600943 | 9/2006 |

* cited by examiner

*Primary Examiner*—Cheryl J Tyler
(74) *Attorney, Agent, or Firm*—Ade & Company Inc.; Kyle R. Satterthwaite; Ryan W. Dupuis

(57) ABSTRACT

A cooling module mountable within a cabinet to provide cooling of the interior thereof has a cold end of its cooling system exposed to an exterior of the module at a top or bottom wall of its casing. A fan is mounted within the cabinet to discharge warm air heated by a hot end of the cooling system through discharge openings provided in an end panel of the casing. Cabinet walls may be provided in the form of one or more laminate sheets having an insulating layer and an exterior cladding. The one or more sheets may be bent or assembled as needed to form the cabinet structure. Shipping the cabinet to an end user or intermediary in flat panel form reduces the necessary volume of packaging to ease handling and reduce shipping costs.

19 Claims, 10 Drawing Sheets

FIG. 8
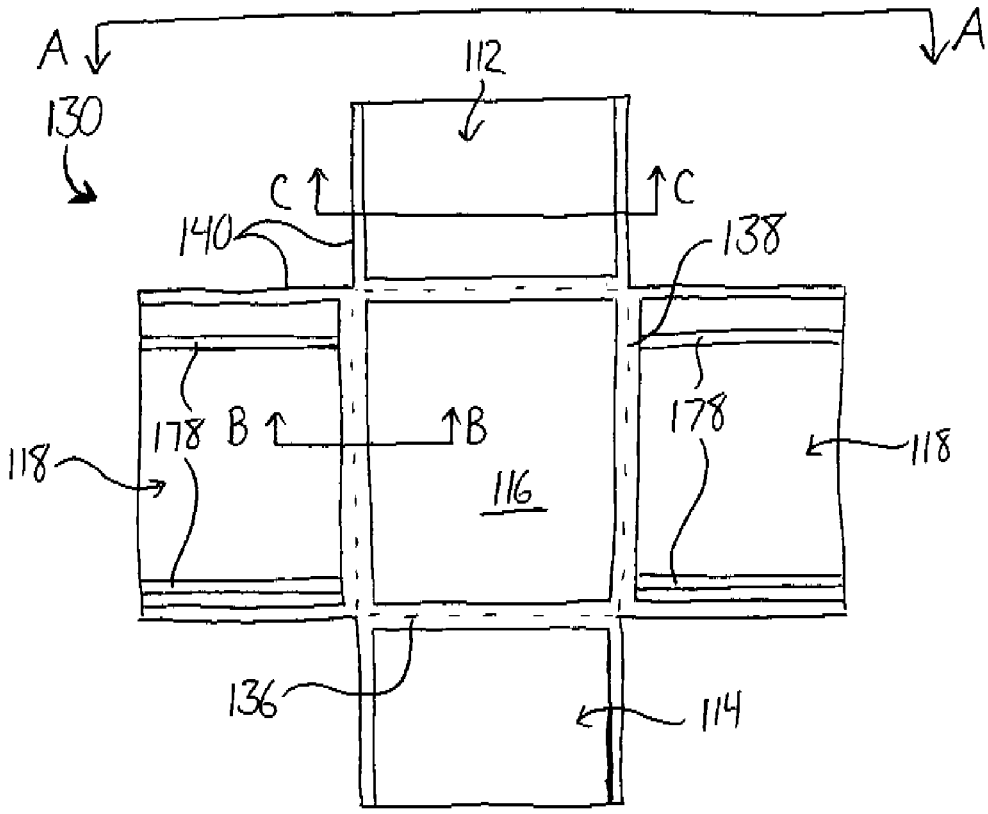
FIG. 8A
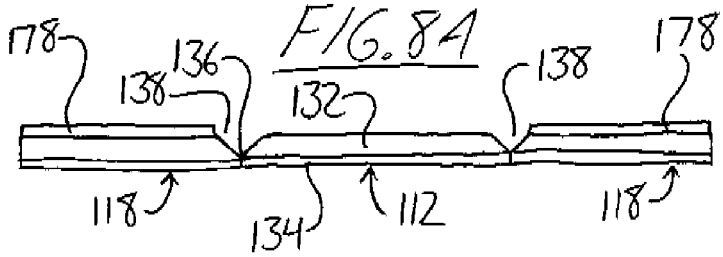
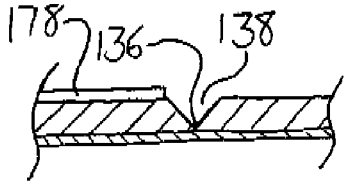
FIG. 8B
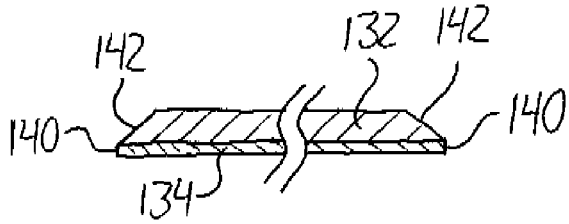
FIG. 8C

FIG. 9
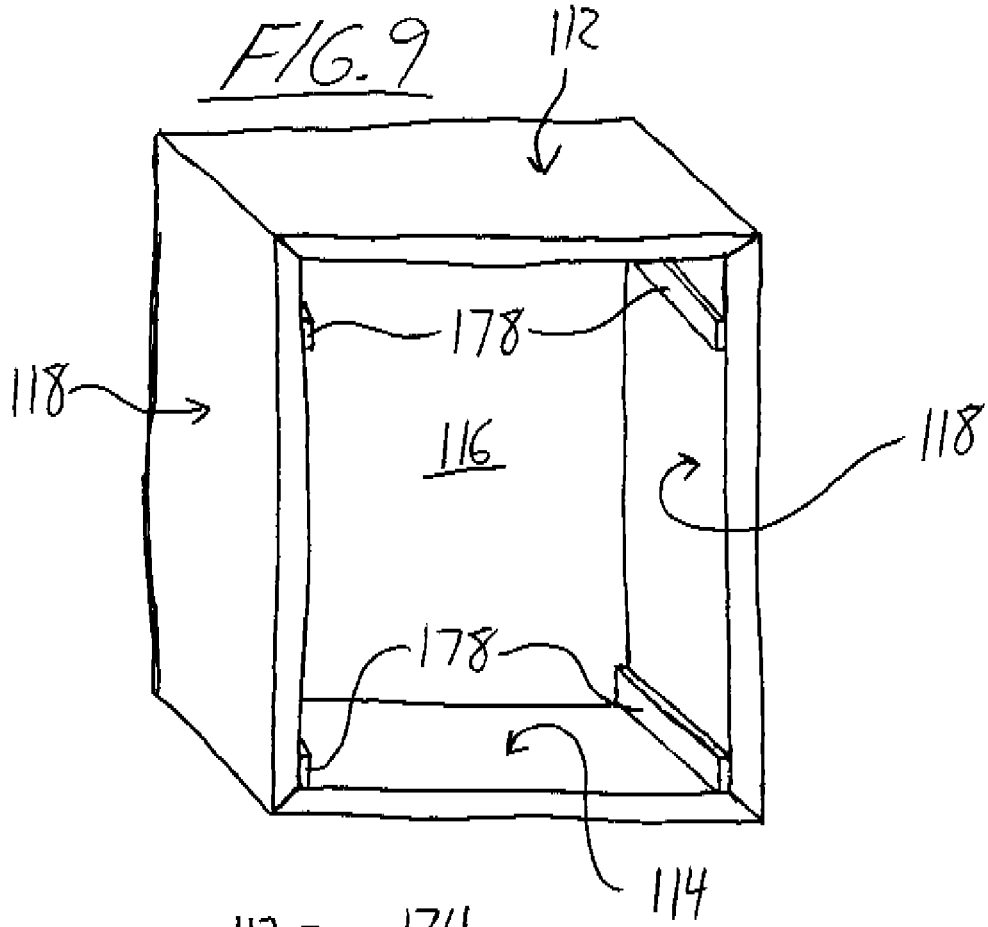
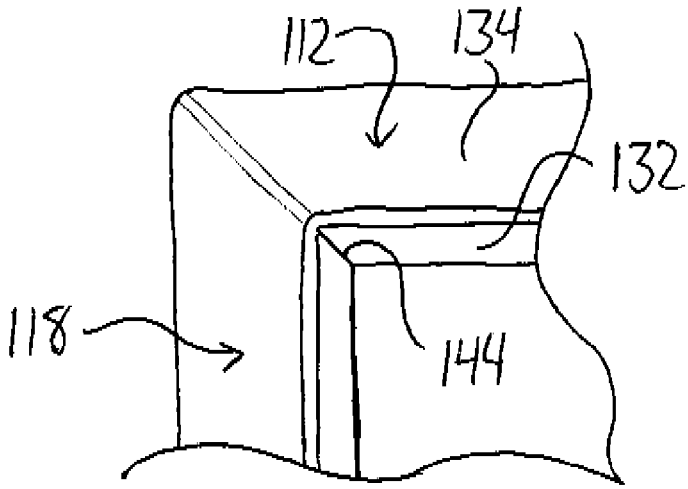
FIG. 9A

REFRIGERATED CABINET AND COOLING MODULE FOR SAME

The present invention relates to a refrigerated cabinet primarily, but not exclusively, designed for cooling wine bottles and a cooling apparatus for cooling the interior of any cabinet having walls that may be, if not already, equipped with insulation.

BACKGROUND OF THE INVENTION

One example of a refrigerated cabinet is disclosed in my prior PCT Published application PCT/CA2005/044060 published 19$^{th}$ May 2005 which discloses a modular system of providing a cooling cabinet primarily for wine bottles where the cabinet and the storage capacity provided thereby can be increased by adding further modules to the construction. In this device the cooling is provided in one embodiment by a conventional cooling system located in the cabinet itself or in a second arrangement, the cooling is provided as separate cooling elements each within a respective one of a plurality of cooling racks located in the cabinet.

In U.S. Pat. No. 6,715,298 (Guo) assigned to Hebei Energy Conservation and issued Apr. 6, 2004 is disclosed a thermoelectric cooling element where a conventional cooling plate uses the thermoelectric effect to form a cooled end and a heated end. A heat dispersing member is connected to the hot end which will cooperate with a fan for discharging heated air from the heated end, and a cool transmitting member is connected to the cool end. The patent disclosure relates to the technique for connecting these components.

In U.S. Pat. No. 6,173,575 (Hall) issued Jan. 16, 2001 is disclosed a food contact machine such as a meat slicer where a modular cooling element using the thermoelectric effect can be inserted into the construction to effect cooling of the machine.

In U.S. Pat. No. 6,581,389 (Rudick) issued Jun. 24, 2003 is disclosed a Coca Cola dispensing machine which includes a conventional cooling module which can slide into the machine.

In U.S. Pat. No. 6,463,754 (Matesanz) issued Oct. 15, 2002 is disclosed a cabinet for cooling wine bottles which has a series of vertical panels for supporting the bottles and a refrigeration element using the thermoelectric effect placed close to and parallel to an inside rear wall of the cabinet.

The thermoelectric effect is the conversion of a heat differential into electric voltage or the conversion of electrical voltage into a heat differential. The production of voltage from a difference in heat is known as the Seebeck effect while the use of electric voltage to produce a heat difference, for example for the purpose of cooling an enclosed space, is known as the Peltier effect. Thermoelectric cooling systems can be used in different thermoelectric orientations as no refrigeration fluids are utilized and have significant lifespans due to a lack of moving parts.

The amount of cool generated through the Peltier effect in currently available units is typically insufficient for many applications such as freezers or air conditioning but can be, and is widely, used in chillers for beverages such as wine coolers. In such chillers, the thermoelectric cooling units are often installed inside walls of the enclosure before the injection of insulation during manufacturing. This may make any necessary repair or maintenance difficult due to accessibility issues.

SUMMARY OF THE INVENTION

According to a first aspect of the invention there is provided a cooling module comprising:

a casing defining a top wall, a bottom wall, two side walls and two end faces, one of the end faces having discharge openings therein;

a cooling system supported within the casing and having a hot end and a cold end, the cold end being exposed to an exterior of the housing at one of the top and bottom walls;

a fan supported within the casing to discharge heated air from the hot end of the cooling system through the discharge openings.

The module allows any cabinet to be cooled simply by placing the module at the top or bottom of the cabinet's interior for exposure of the air therein to the cold end of the cooling system. The module can therefore be used to replace the cooling system of a previously refrigerated cabinet or provide cooling where there was none previously provided. The module can be transported from one place to another for use with different cabinets.

Preferably the cooling system comprises a thermoelectric cooling cell defining the hot end and cold end.

Preferably the hot end comprises a heat dispersing member and the cold end comprises a cool transmitting member.

Preferably the casing is divided into two chambers, the hot and cold ends being disposed in opposite ones of the two chambers.

Preferably there is provided insulation supported between the hot end and the cold end to resist heat transfer therebetween.

Preferably the insulation divides the casing into top and bottom chambers adjacent the top and bottom walls respectively, the hot and cold ends being disposed in opposite ones of the top and bottom chambers.

Preferably one of the two side walls and two end faces have inlet openings therein and a channel is defined within the casing to extend from the inlet openings to the discharge openings with the hot end and fan disposed in the channel to direct air entering the channel through the inlet openings past the hot end to the discharge openings. Preferably the inlet openings are provided in the one of the end faces having the discharge openings therein. Providing the inlet and discharge openings in the same face of the casing means that only that one face requires exposure to the surrounding environment for operation of the module.

Preferably the cold end is disposed within the casing and openings are provided in the one of the top and bottom walls at which the cold end is exposed to the exterior of the housing. While the cold end and the cool transmitting member could be supported atop the casing for direct exposure to the surrounding air, positioning them within the casing protects the components from accidental damage and maintains compact and ease of placement in various cabinet designs.

Preferably there is provided a second fan associated with the casing to direct air from the exterior of the past the cold end exposed thereto.

Preferably the second fan is a centrifugal fan.

Preferably the cooling module is provided in combination with a cabinet, the cabinet being formed of insulated panels including a top wall, a bottom wall, side walls and a rear wall connected to define an open front and a front door connected to the cabinet and movable between an open position exposing the open front and a closed position at least partly covering the open front, wherein the side walls of the casing having slide members supported thereon at the exterior of the casing for engaging cooperating slide members on the inside surface of the side walls allowing sliding movement of the casing into the cabinet through the open front face to allow cooling to be provided within the cabinet by the cold end of the cooling system.

The front door may be dimensioned to define a slot shaped opening portion of the open front below the front face of the door and the casing is located at the bottom of the cabinet with the cold end exposed to the exterior of the casing at the top wall thereof and with the discharge openings aligned with the opening portion. Alternatively, the front door may be dimensioned to define a slot shaped opening portion of the open front above the front face of the door and the casing is located at the top of the cabinet with the cold end exposed to the exterior of the housing at the bottom wall thereof and with the discharge openings aligned with the opening portion. As a further alternative, the door may be arranged to cover the whole of the front opening and to include an opening which aligns with the front openings in the casing to allow the heated air to escape. Having the module arranged to discharge hot air from the front of the cabinet allows the cabinet to be backed against a wall or other surface or into a corner without worrying about blocking the exhaust. This reduces the space requirement as it is not necessary to leave space between the cabinet and the wall.

Preferably the casing spans the full width between the side walls of the cabinet. The intention is that the casing is shaped and arranged in conjunction with particular components of the cooling system so that the full width is effectively utilized while allowing the height of the casing to be minimized. Different casings can be manufactured to cooperate with different size or different width cabinets. However the width of the casing may be less than the full width and supports or slide members can be provided which take up some of the width, allowing a narrower casing to be used with a wider cabinet. The wide casing allows a full width of the front face to be used as a heated air release area.

Preferably the side walls of the cabinet have rails attached thereto on which the casing slides. These are preferably pre-applied in a kit of parts for assembly into the cabinet. However slots in the side walls can also be used as a simple support for the casing.

The side walls of the cabinet have may have rails located for mounting the casing at the top or the bottom as selected by the user. Thus the same kit of parts can be used for different assemblies by the user selecting how to mount the door and where to mount the cooling module, at the top or bottom, and the necessary rails or other mounting elements can be provided at the top and bottom.

As the primary, but not exclusively, proposed use of the refrigerated cabinet is that of wine storage the side walls of the cabinet may have additional rails for sliding into the cabinet at least one bottle storage rack. However the racking provided may simply sit on the bottom wall or on the cooling module at the bottom.

According to a second aspect of the invention, there is provided a refrigerated cabinet comprising:

a cabinet formed of insulated panels including a top wall, a bottom wall, side walls and a rear wall connected to define an open front;

a front door connected to the cabinet and movable between an open position exposing the open front and a closed position at least partly covering the open front;

wherein the panels are formed from a laminate defined by a layer of an insulating foam material and an exterior cladding material;

wherein at least some of the panels are supplied as a flat continuous sheet of the laminate which can be bent at corners to define the panels.

Preferably all of the panels are supplied as a flat continuous sheet of the laminate which can be bent at corners to define the panels. Thus the side top and bottom panels may be arranged in a row with parallel spaced bend lines with the rear panel attached to one of the panels with a bend line at right angles to the bend lines of the other panels.

In order to make the bend line neat and effective, preferably the insulating material is cut away into a 90 degree angle at the corner defining an intended bend line and the panels remain connected by the exterior cladding which is bent at the corner.

Preferably the exterior cladding is a metal sheet which can remain integral when bent through the required 90 degrees but other materials can be used.

BRIEF DESCRIPTION OF THE DRAWINGS

Exemplary embodiments of the invention will now be described in conjunction with the accompanying drawings in which:

FIG. 8 is an overhead plan view of an unfolded laminate sheet used to form panels of the refrigerated cabinet of FIG. 7.

FIG. 8A is a view of the unfolded laminate sheet as taken along line A-A of FIG. 8.

FIG. 8B is a partial cross-section view of the unfolded laminate sheet as taken along line B-B of FIG. 8.

FIG. 8C is a partial cross-section view of the unfolded laminate sheet as taken along line C-C of FIG. 8.

FIG. 9 is a front isometric view of the laminate sheet of FIG. 8 having been folded to form the panels of the refrigerated cabinet of FIG. 7.

FIG. 9A is a close up of an edge of the folded laminate sheet of FIG. 9.

In the drawings like characters of reference indicate corresponding parts in the different figures.

DETAILED DESCRIPTION

Figure 1:
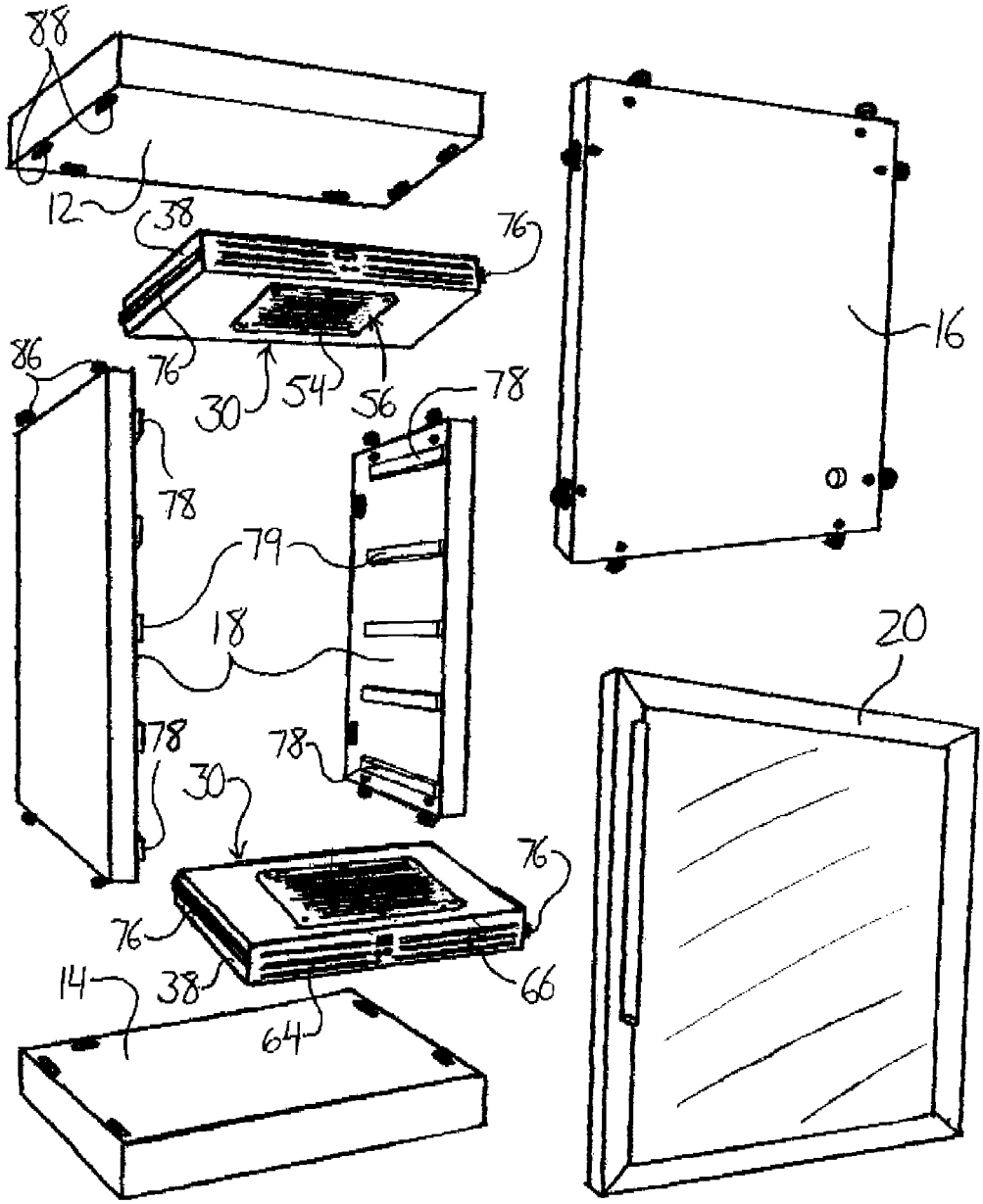
FIG. 1 is an unassembled perspective view of a cooling cabinet using a pair of cooling modules according to the present invention.
Figure 2:
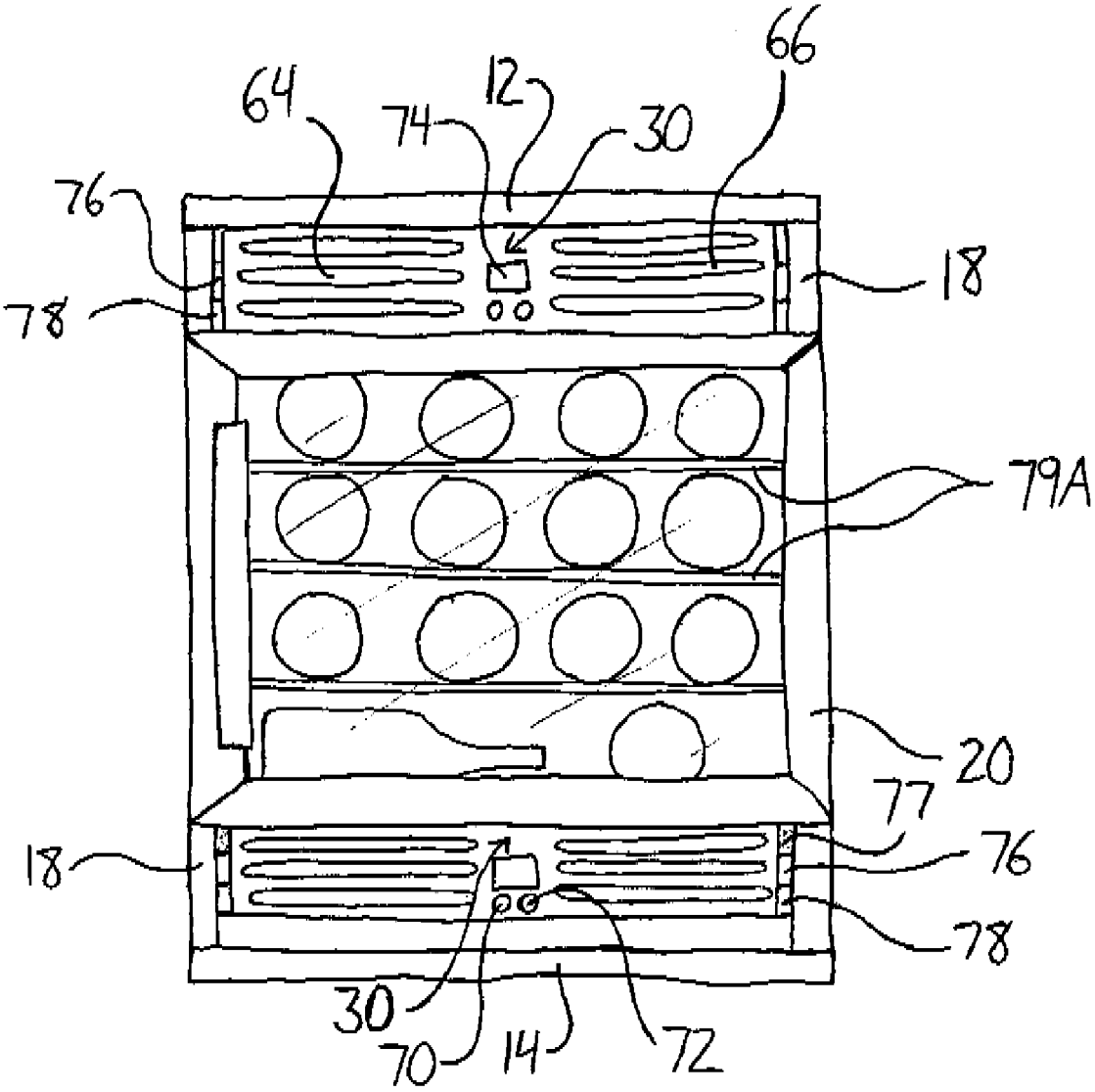
FIG. 2 is an assembled front view of the cooling cabinet of FIG. 1.
Figure 3:
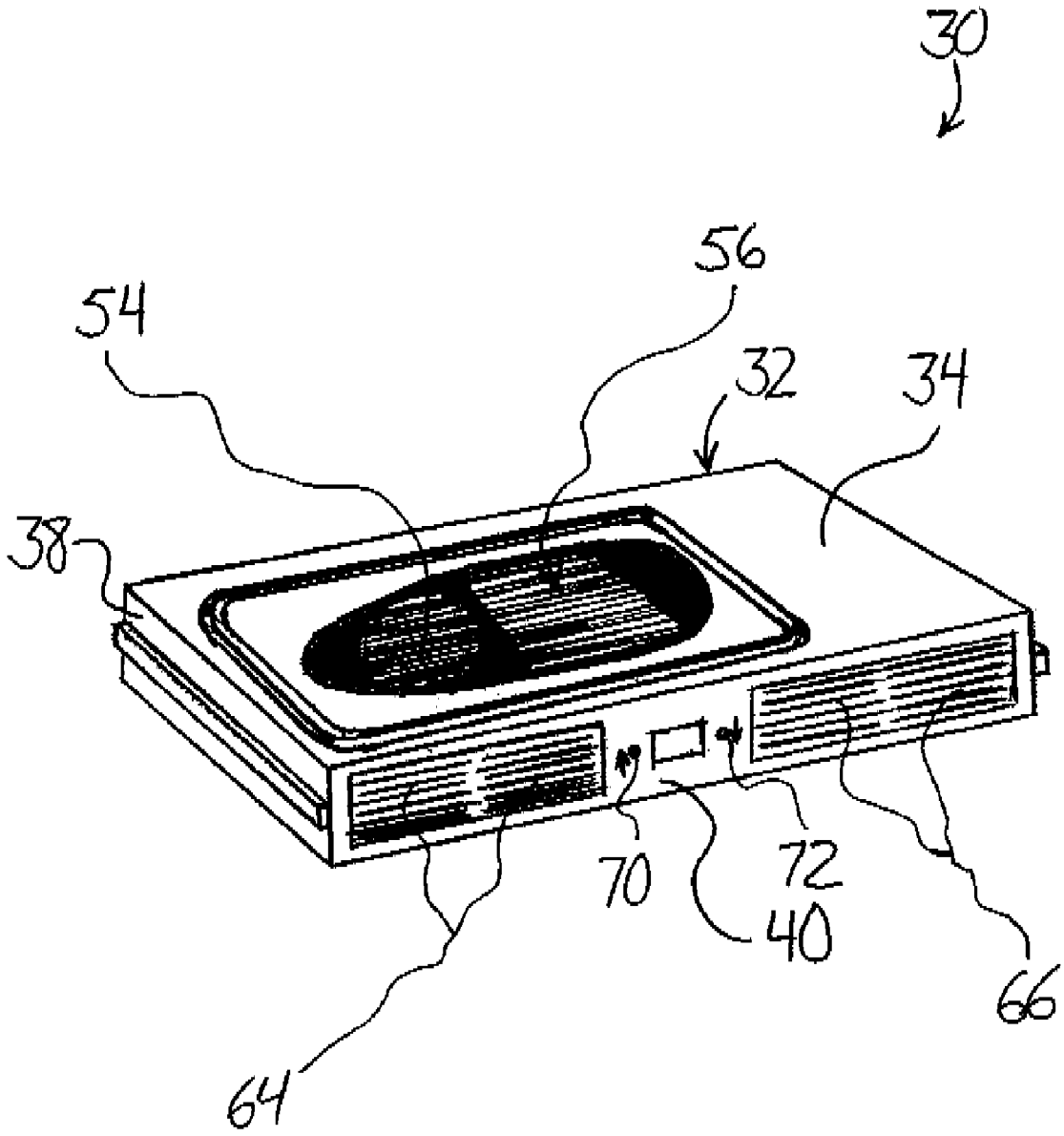
FIG. 3 is a front isometric view of one of a cooling module according to the present invention.

FIGS. 1 and 2 show a refrigerated cabinet 10 that makes use of slide-in cooling modules. The cabinet 10 features insulated panels forming a top wall 12, bottom wall 14, rear wall 16 and two sides walls 18 assembled and interconnected to define an interior having an open front end. The cooling modules 30 are arranged to slide into the cabinet from the open front end 10 at the top and bottom of the interior. The modules adjacent the top and bottom walls of the cabinet provide cooling from their bottom and top surfaces respectively to cool the air between the modules within the cabinet interior. A door 20 is pivotally mounted on the panels at the open front end to enable opening and closing of the cabinet by pivoting the door between open and closed positions in which the open front end is at least partially unobstructed and fully covered respectively. The cooling modules 30 are easy to install, easy to remove and allow the conversion of essentially any cabinet-like structure into a refrigerated cabinet, for example for use a wine cooler.

FIGS. 3 to 6 illustrate a cooling module 30 for mounting at the bottom of a cabinet to provide cooling of the air above the module within the cabinet's interior. The cooling module features a casing 32 having a top wall 34, a bottom wall 36, two side walls 38, a front face 40 and a rear face. The casing may be made of, for example, metal or molded plastic. Inside the casing, the module features a cooling system 42, for example a thermoelectric cell, having a hot end 44 and a cold end 46 with a heat dispersing member 48 provided on the hot end 44 and a cooling transmitting member 50 provided on the cold end. The heat dispersing member may be, for example, a heat sink or a heat pipe. The cooling transmitting member may be, for example, any one of a finned member, a pinboard member, a ribbed member and a needle member. The thermoelectric cell divides the interior of the casing 32 into two portions, one containing the heat dispersing member 48 and the other containing the cool transmitting member 50. Insulating material 52 surrounds the thermoelectric cell to close off these portions from one another such that the casing interior is divided into separate upper and lower compartments, The insulating material 52 resists heat transfer between the two compartments.

As the illustrated module 30 is intended to cool the air above it from the bottom of the cabinet interior, the top wall 34 is provided with openings 54 which may be defined, for example, by a grate 56. While a single large opening would similarly allow air to enter the module to reach the cool transmitting member 50, smaller openings, as provided by a grate or mesh, help prevent damage to the module or injury to a user by obstructing access to the interior of the casing. While cooling of the cabinet's interior is carried out by the cold end 46 of the thermoelectric cell through the cooling transmitting member 50, warm air heated by the hot end 44 through the heat dispersing member 48 is exhausted from the front face 40 of the casing.

Figure 5:
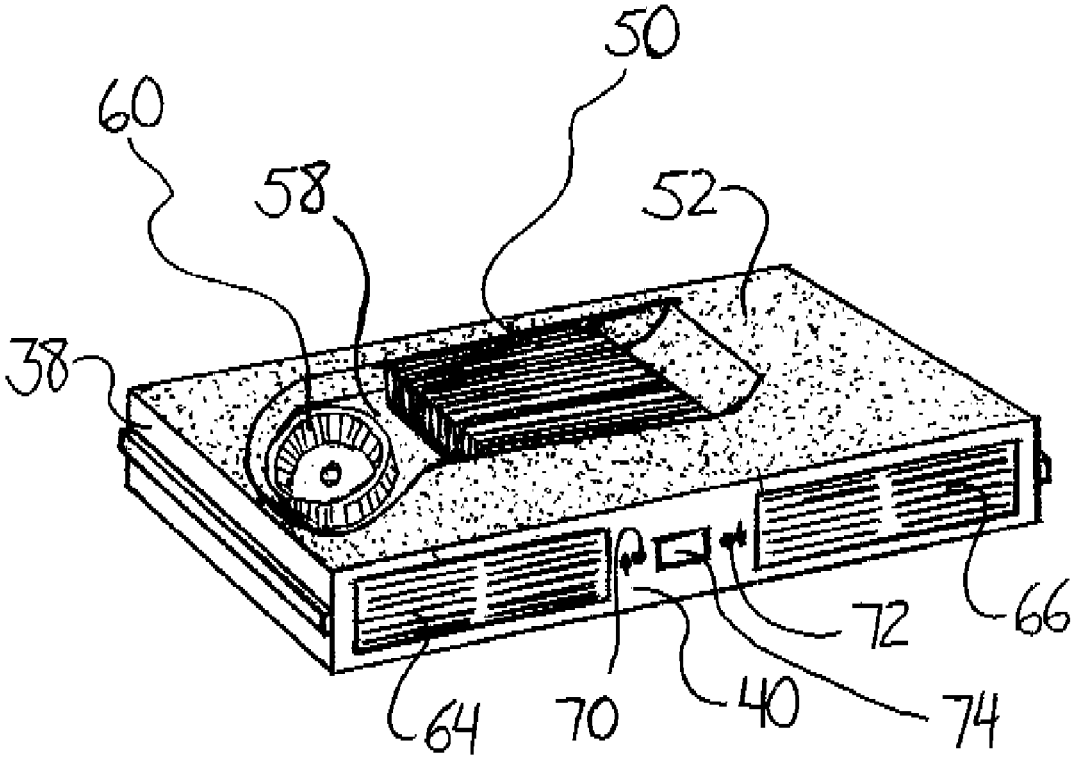
FIG. 5 is a front isometric view of the cooling module of FIG. 3 with a panel removed to show a cold side of the cooling module's interior.
Figure 6:
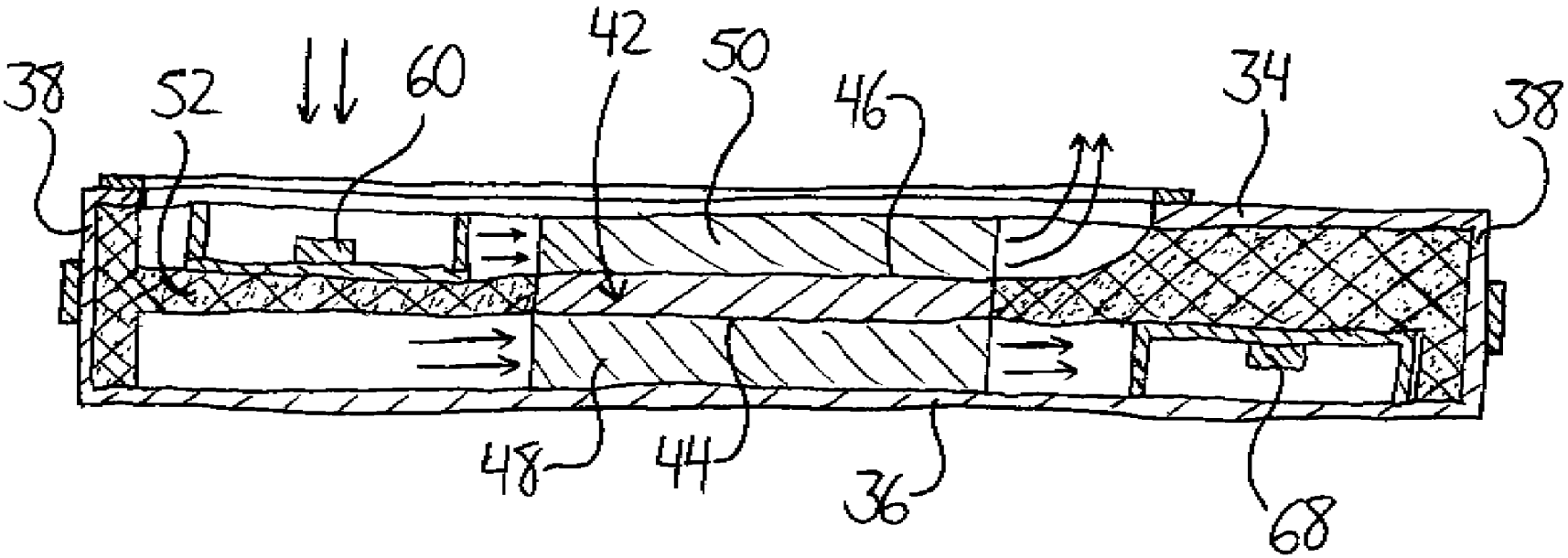
FIG. 6 is a cross sectional view of the cooling module of FIG. 3 as taken along line 6-6 of FIG. 5.

FIG. 5 shows the cooling module 30 with the top wall panel 34 removed to illustrate the upper compartment of the casing's interior in which cooling of the cabinet interior's air is carried out. The insulating material 52 extends upward from the area surrounding the thermoelectric cell to the top of the side walls 38 and end faces where the top wall 34 is supported, but a portion of the insulating material 52 is recessed therefrom on opposite sides of the cooling transmitting member 50 to form a channel 58 along which air from above the cooling module, supplied through the openings 54 with the top wall panel 34 installed, can flow. With this channel 58 so formed by recesses on opposite sides of the thermoelectric cell and extending to a depth from the top of the module passed, the cooling transmitting member 50 lies in the middle of the channel so as to be exposed to airflow therealong. To improve this airflow, a fan 60 is provided in the channel 58 to force air past the cooling transmitting member 50. The use of a centrifugal fan, having its shaft oriented generally vertically and its outlet directed generally horizontally along the channel 58 toward the cooling transmitting member 50, for this purpose forces air drawn downward from above the cooling module 30 across the cooling transmitting member. The floor of the channel 58 slopes upward away from the cooling transmitting member 50 on the side opposite the fan 60 so that air having passed the cooling transmitting member is directed upward into the cabinet interior through the openings 54 in the top wall panel 34.

Figure 4:
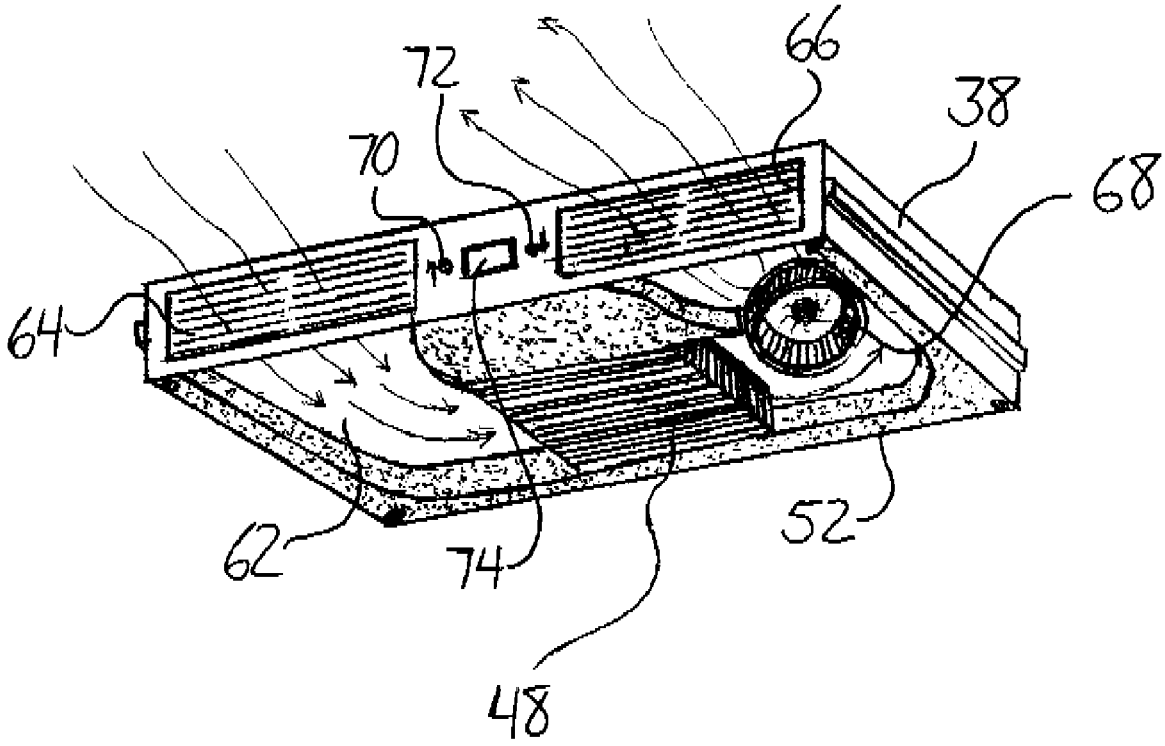
FIG. 4 is a front isometric view of the cooling module of FIG. 3 with a panel removed to show a hot side of the cooling module's interior.

FIG. 4 shows the cooling module 30 with the bottom wall panel 36 removed to illustrate the lower compartment of the casing's interior in which heat is dissipated from the thermoelectric cell 42. As in the upper compartment, airflow is used to effect heat transfer, but the directional source and discharge of air is horizontal rather than vertical, as the module is to be supported at the bottom of a cabinet. The insulating material 52 extends downward from the area surrounding the thermoelectric cell 42 to the bottom of the side walls 38 and end faces where the bottom wall is supported, but a portion of the insulating material 52 is recessed therefrom to form a generally U-shaped channel 62 extending generally horizontally from inlet openings 64 in the front face 40 proximate one of the side walls 38 to discharge openings 66 in the front face proximate the opposite side wall. The inlet and discharge openings in the front face of the cooling module face away from the casing in a common direction and communicate the lower compartment with the exterior of the casing at only the front end thereof. The heat dispersing member 48 on the hot end 44 of thermoelectric cell 42 is disposed in the channel 62 between the inlet and discharge openings to dump heat to air flowing therebetween. As with the upper chamber, a fan 68 is provided to promote airflow through the channel 62 in one direction. A cross-flow fan or one or more axial fans may be set up to extend across the channel 62 to encourage airflow across the heat dispersing member 48. The fan thus discharges air from the lower compartment through the discharge openings in the front face after entry of the air into the lower compartment through the inlet openings in the front face and heating of the air in the channel by the hot end of the cooling system.

It should be appreciated that the depths of the separate chambers associated with the hot and cold ends of the thermoelectric cell are chosen to ensure that a layer of the insulating material remains between them to both prevent the mixture of air from inside and outside the cabinet and to restrict heat transfer back up toward the interior of the cabinet.

The module 30 is provided with temperature monitoring and control systems. In the illustrated embodiment, a user can control the temperature of the cabinet through operation of an up button 70 and a down button 72 used to increase and decrease the desired temperature of the cabinet interior respectively. A digital display 74 is coupled to the thermoelectric cell controller and to a temperature sensor in order to provide a user with a visual indication of both the current temperature of the cabinet interior and the temperature which the module has been set to maintain. The use and connection of such monitoring and control components is known to those of skill in the art, as they have been used in prior art thermoelectric wine cooling cabinets.

The cabinet 10 of FIGS. 1 and 2 uses two cooling modules 30, one situated at the top of the cabinet's interior adjacent the top wall 12 and one situated at the bottom of the cabinet's interior adjacent the bottom wall 14 at the base of the cabinet. The lower cooling module is of the structure outlined above. The upper cooling module is similar to the bottom module, but flipped over to dispose the cooling side at the bottom of the module so as to expose the cooling transmitting member 50 on the cold end 46 of the thermoelectric cell 42 to the cabinet's interior through openings 54. The upper cooling module is oriented such that the inlet and outlet openings 64, 66 in the end face 42 are disposed at the front of the cabinet 10 just like the lower module. The position and orientation of the control buttons 70, 72 and digital display 74 relative to the grate 56 is changed from that of the lower module to read properly with the upper module in the operational position shown in FIG. 1.

On each side wall 38 of the cooling modules 30, there is provided a rail 76 extending along the side wall between the end faces of the casing. The cooling module rails 76 cooperates with respective rails 78 on the side walls 18 of the cabinet to guide sliding motion of the modules into the cabinet interior and support the modules therein. In other words, the cooling module rails 76 sit atop the cabinet rails 78 extending generally horizontally along the side walls 18 between the front and rear of the cabinet to support the cooling modules and a sliding action between the module rails and cabinet rails allows smooth, easy insertion and removal of the modules from the cabinet interior. It should be appreciated that elements other than rails may be used to provide a similar engagement between the modules and the cabinet. For example, replacement of each rail of either the module or cabinet rail set with horizontally spaced rollers would allow the remaining rail set to roll along the rollers and provide similar slide-like motion of the modules. As another example, one rail set may be replaced with grooves such that the remaining rails slide into and out of grooves. Alternatively, the lower module may simply be slid into and out of the cabinet interior along the bottom wall 14 and sit thereatop during use, thereby eliminating the need for slide members between the casing side walls 38 and cabinet side walls 18.

As shown in FIG. 1, the cabinet side walls 18 may be provided with additional rails 79 in order to support shelves or racking 79A within the cabinet interior, as shown in FIG. 2, for storage of the desired cabinet contents, for example wine bottles.

As shown in FIG. 2, the door 20 of the cabinet 10 is sized so as not to extend the full height of the interior, but rather to leave a slot-like portion of the cabinet's open front uncovered both above and below the door. In cabinet designs where only one cooling module will be used, the doors would be designed accordingly, for example, extending immediately from the bottom wall up a suitable height to create only a single slot above the door. It is in these slots that the cooling modules are situated for use. The inlet and exhaust openings 64, 66 of the cooling modules are thus unobstructed to allow flow of air to and from the module 30 for removing heat from the heat dispersing member 48 and the hot end 44 of the thermoelectric cell 42. As shown in the upper slot of FIG. 2, the cooling module 30, cabinet rails 78 and door may be positioned to seal against one another to cooperatively close off the interior of the cabinet along the doors edge to prevent loss of cool air to the surrounding environment. Any empty space between a module and the door or side walls of the cabinet that is in communication with the door-covered portion of the cabinet's interior is closed off with insulating material, as shown at 77 in FIG. 2. Alternatively, both cooling modules can be configured with the cabinet to fill any such space. For example, movement of the cooperating rails 76, 78 of the lower module of FIG. 2 upward to align the module rails 76 with the top wall 34 of the module casing would close off the open spaces between the module and side walls at the door edge, just like the cooperating rails of the upper module. Alternatively, simply extending the height of the module rails 76 of the bottom module to again align them with the top wall 34 without moving the cabinet rails 78 would have the same effect. As another example, eliminating the module rails 76 altogether, increasing the size of the module casing 32 to extend fully between the cabinet side walls 18 and lowering of the cabinet rails 78 from their illustrated positions would allow the bottom wall panel 36 to sit atop the cabinet rails and eliminate gaps between the cooling module 30 and cabinet side walls 18.

A cabinet having a door extending the full height of its interior would require openings to be provided in the door for alignment with the inlet and discharge openings of the cooling modules with the door in the closed position. In such an arrangement, seals extending about the openings with the door in the closed position could prevent leakage of the heated discharge air into the cooled interior of the cabinet.

The walls of the cabinet 10 may be provided with cam locks 86 arranged to connect one wall to another through latching of cam locks of one wall within respective slots 88 provided in another. Other fastening methods to secure cabinet walls together are known to those of skill in the art.

The cabinet 10 of FIGS. 1 and 2 is merely one example of a cabinet with which the cooling module 30 of the present invention may be used. The slide in cooling modules and cam lock connections allow easily assembly of the cabinet so that its components may be compactly packaged in a kit to facilitate safe and affordable shipping to a customer or intermediary for final assembly thereby. Such a kit may include a single cooling module 30 and provide the option of adding additional cooling modules as desired. It should be appreciated however, that a single cooling module may be sold on its own, thereby allowing an end user to convert any cabinet or similar openable enclosure into a refrigerated space. For example, a kitchen cabinet may be lined with panels of insulating material and equipped with a cooling module to form a built-in kitchen wine cooler.

Figure 7:
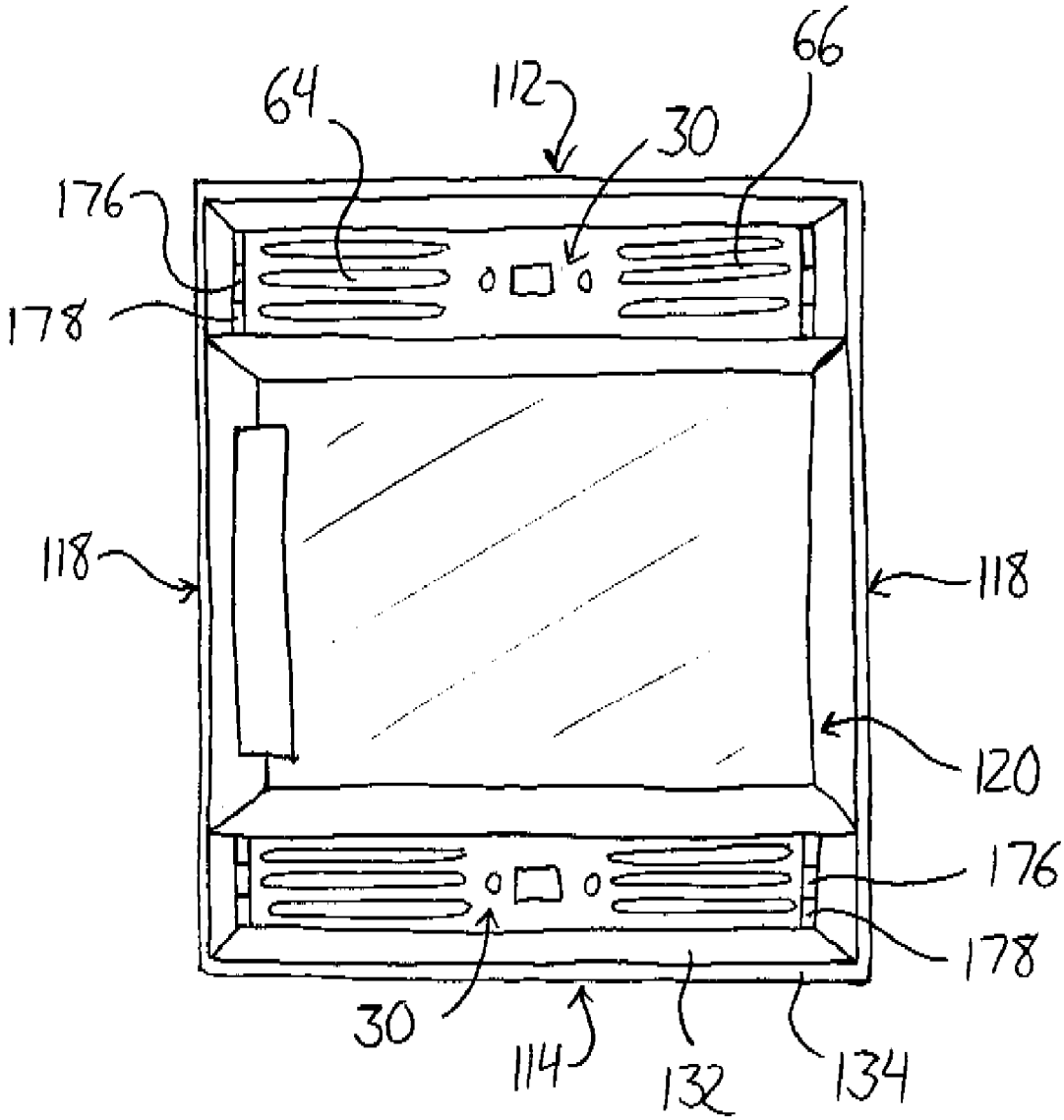
FIG. 7 is a front view of a refrigerated cabinet according to the present invention.

FIGS. 7 to 9 show an affordable, easy to assemble insulated cabinet 100 that can make use of one or two of the cooling modules 30 described above to provide refrigeration, for example for use as a wine cooler. Similar to that of FIG. 1, the cabinet 100 features panels defining a top wall 112, a bottom wall 114, a rear wall 116, two side walls 118 and a door 120. The door 120 does not extend the full height of the cabinet interior, but rather leaves open slots at the front of the cabinet at the top and bottom of the interior where the cooling modules 30 are provided. This eliminates the need to provide openings in the door 120 to allow air to enter and exit the modules 30 through the inlet and discharge openings 64, 66.

The wall panels 112 to 118 of the cabinet 100 are formed by a single flat sheet 130. The sheet has a generally t-shaped or cross-shaped configuration in that it has the appearance of a rectangular sheet with an equally sized rectangular portion removed from each corner thereof. A central rectangular portion of the sheet 130 defines the rear wall panel 116 of the cabinet with each of the other four wall panels extending outward therefrom. The side wall panels 118 extend from opposite sides of the central rear wall panel 116, as do the top and bottom wall panels 112, 114. As shown in FIG. 8A to 8C, the sheet 130 is a laminate composed of a layer of insulating material 132 and a layer of cladding material 134. The insulating layer 132 acts to resist heat transfer between the cabinet interior and the surrounding environment while the cladding material 134 protects the cabinet from damage and adds strength and rigidity.

The cabinet 100 is formed by folding the laminate sheet 130 along the borders between the panels, which together outline the perimeter of the central rear panel 116 as indicated in FIG. 8 by broken lines 136. FIG. 8A shows that right-angle triangular grooves are formed in the insulating layer 132 along the fold lines 136 such that the right-angle vertex of the triangular cross-section lies on the fold line 136. These grooves allow bending of the panels from the flat sheet configuration without damage to the insulating layer 132 with the walls of each triangular groove meeting after ninety degrees of bending. To form the cabinet, each of the side, top and bottom wall panels of the sheet 130 are bent ninety degrees relative to the central rear wall panel 116 toward the insulating layer 132. In each of the empty corners of the sheet 130, the edges 140 of the outer panels (i.e. the side, top and bottom panels extending outward from the central rear panel 116) feature the insulating layer 132 cut at forty-five degrees to the underlying cladding layer 134 such that the resulting sloped surfaces 142 will fit flush against one another upon the ninety degree bending of the outer panels. The example of one such junction is shown at 144 in FIG. 9A.

The grooves 138 of right angle triangular cross-section may be considered similarly formed by forty-five degree sloping of the insulating layer 132 along panel edges, as such sloping along the border of the central rear panel 116 and the edges of the adjacent outer panels integral therewith collectively forms the previously described triangular grooves. The edges of the outer panels opposite the sides of the central rear panel 116 from which they extend need not be shaped this way, as they are disposed at the open front of the cabinet upon folding of the laminate sheet 130, and thus do not mate with other edges of the panels.

As shown in the Figures, the triangular grooves 138 may extend fully through the insulating layer 132 to the cladding layer 134 so that the bending between the panels occurs only in the cladding layer. This may help prevent damage to the insulating layer 132, for example cracking of the insulation during bending where relatively brittle insulating material is used. With two outer panels bent perpendicular to the central rear panel 116 as shown in FIG. 9A, they are secured together for example by adhesive applied along the sloped edges forming the juncture 144 or by suitable fasteners known to those of skill in the art. It should be appreciated that the laminate sheet 130 does not have to be of the cross-shaped or t-shaped configuration shown in which three panels are arranged edge-to-edge in each direction. Four example, a single sheet defining all five wall panels may be arranged four panels (the top, bottom and both side panels) edge to edge in one direction with the remaining panel (the rear panel) extending from a free edge of one of the other four panels.

As shown in the Figures, the laminate sheet 130 may feature rails 178 already installed on the side wall panels 118 thereof before delivery to the end-user to further simplify assembly. A pair of rails installed one on each of the side wall panels 118 in an aligned manner proximate the top wall panel 112 facilitate the sliding installation of a cooling module 30 having rails 76 thereon into the top of the cabinet interior once the walls panels are properly bent from the flat sheet condition and secured together. A pair of rails can similarly be provided on the flat sheet 130 proximate the bottom wall panel 114. Alternatively rails could be provided with the sheet and at least one cooling module as part of a kit and installed by the end-user, for example by means of adhesive or fasteners. Additional rails may be provided on the wall panels to support shelves or racking within the cabinet interior as is known to those of skill in the art. As with the cabinet of FIGS. 1 and 2, alternative sliding members may be used in place of cooperating rails.

It should be appreciated that the wall panels 112 to 118 may be provided as more than one sheet of laminate. For example, the five wall panels may be provided in two foldable sheets rather than one, or the laminate may be provided in the form of at least one bendable sheet defining more than one panel and other sheets defining respective individual panels. As a further example, conceptualizing the broken lines 138 of FIG. 8 as cut lines, it should be appreciated that the wall panels 112 to 118 may be provided as individual sheets of laminate. When the wall panels are provided as individual sheets where bending is not required, the sheets may be constructed of injection molded plastic panels each provided with an insulating layer.

Regardless of the number of sheets provided in a cabinet-producing kit, providing the wall panels in an unassembled state to an intermediary or end user reduces the volume of the shipping package by eliminating empty space within the package that would normally constitute at least a portion of an assembled cabinet's interior. The result is a package that may be easier to handle and more affordable to ship. Depending on the size of the panels, providing them in the form of one or more multi-panel sheets may not result in improved handling properties and shipping rates, despite reduced volume, due to significant planar dimensions. Reduction of the laminate into sheets of fewer panels allows face-to-face stacking thereof into a low volume package with reduced planar dimensions.

Even when not provided together in a foldable multi-panel sheet, mating panels may be provided with mating edges cut to complementary angles (summing to ninety degrees), for example forty-five degrees each as described above. This can hide the interface between the end of the insulating layer of one panel and the panel mating therewith, except at the front of the cabinet as shown in FIG. 9, and aid in proper alignment of the wall panels. Strips of the exterior cladding, or some other material, may be used to cover the exposed ends of the insulating layer at the front face of the cabinet to improve its appearance. Similarly, the planar faces of the insulating layer may be coated or covered by a suitable material to improve the appearance of the cabinet's interior, either during production or by the assembler. A door should be provided as part of any wall panel kit for pivotal mounting to the final cabinet structure by methods known to those of skill in the art, such as pin or hinge mounting.

Although each of the illustrated cabinets features two cooling modules 30, it should be appreciated that a single cooling module may be sufficient to cool a relatively small enclosure and also that more than two modules may be used to cool enclosures of larger size. Modules that extend the full width and depth of the cabinet act to seal of sections of the cabinet's interior by mating with the walls thereof, while smaller modules allow airflow thereabout within the interior. Such sealing may be provided by closing any space between the module and the cabinet walls with the rails on which the module may be supported (see the top module of FIG. 7). Therefore multiple cooling modules may be used to have a combined cooling effect on a fixed volume or to divide such a volume into a plurality of smaller volumes, each cooled by respective one or more modules. Furthermore, it should be appreciated that more than one thermoelectric cooling cell may be provided within the cooling modules of the present invention.

It should be appreciated that the fans, thermoelectric cell and the control mechanisms of the cooling modules 30 are coupled to a suitable power source connection. This may be done, for example, by providing each module with a conventional power cord extending outward from electrical connections within the casing to feed through an opening provided in one of the cabinet walls for connection to a conventional household electrical outlet. Alternatively, the cabinet may be provided with a power distribution device connected to a conventional household electrical outlet, with each module being plugged into the distribution device. A transformer may be used to alter the voltage provided by a conventional outlet to an operational voltage of the cooling modules, should these values differ. For example, a step-down transformer would allow the operation of a 12-volt module on electricity provided by a 120-volt outlet. Those of skill in the art of wine coolers are familiar with the connection of such components. For portable applications, the cooling modules may be adapted to use a battery or solar power source.

Figure 10:
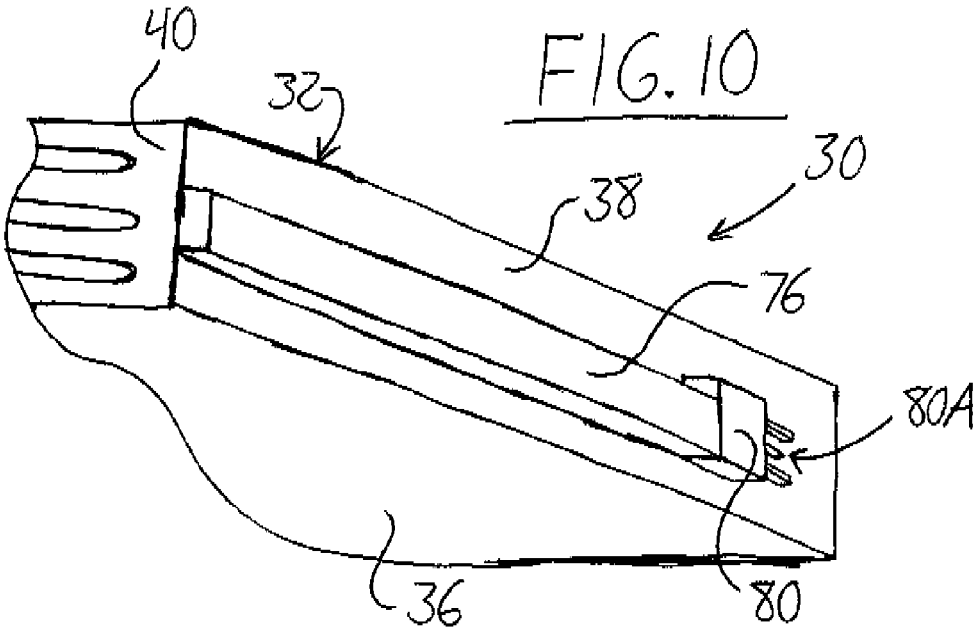
FIG. 10 is a partial isometric view of a cooling module illustrating an electrical connection component mounted thereon.
Figure 11:
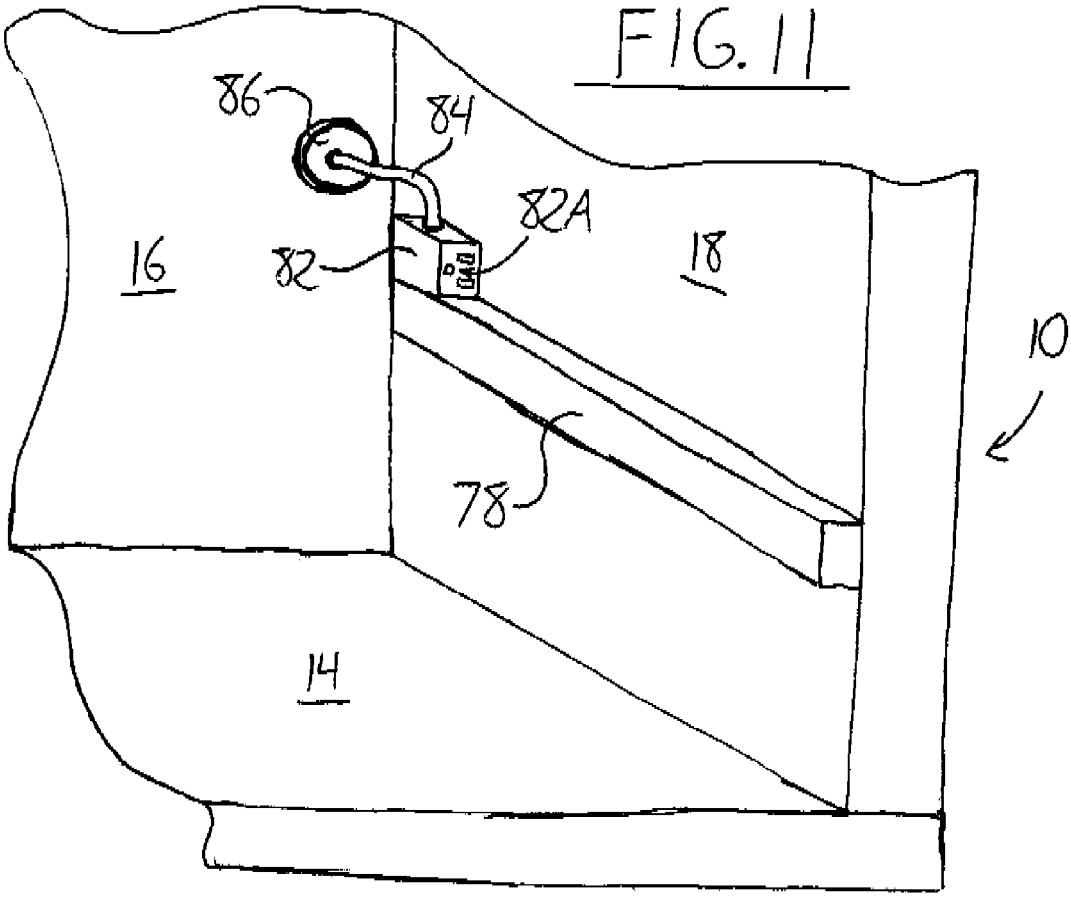
FIG. 11 is a partial isometric view of a cooling cabinet illustrating an electrical connection component mounted thereon for cooperation with that of FIG. 10.

FIGS. 10 and 11 illustrate one possible arrangement for electrical of a cooling module 30 mountable in a cabinet. One of the slide rails 76 on the side walls 38 of the module casing 32 is shortened so as not to extend fully along the side wall, but rather to stop short of the rear face panel opposite the front face panel 40. At this rear end of the rail 76 a male electrical connector 80 having prongs 80A extending rearward therefrom is mounted to the side wall 38 and wired through the casing to the electrical components inside. A respective female electrical connector 82, having slots 82A for receiving the prongs 80A of the male connector 80, is supported on the side wall 18 of the cabinet atop the rail 78 mounted thereon. The slots 82A face toward the front of the cabinet so that when the module 30 is moved into the cabinet by a sliding action between the module rails 76 and the cabinet rails 78, the prongs 80A of the male connector slide into the corresponding slots 82A of the female connector 82. The female connector 82 is wired to a power source, distributor or transformer by a cord 84 fed through an opening in the cabinet's rear wall 16. A grommet 86 seals the opening about the cord to prevent leakage of cooled air from the cabinet's interior. In the Figures, the combined length of the female connector 82, male connector 80 and module rail 76 with the connectors mated equal the length of the modules side wall 38 so that the module sits squarely within the cabinet having its rear face flush with the cabinet's rear wall. It should be appreciated that the male and female connectors may be mounted elsewhere on the module and cabinet while providing the same sliding cooperation.

Although the cooling modules have been presented in the context of cooling a cabinet, for example for the purpose of storing wine, it should be appreciated that they may be used for other purposes. For example, a cooling module may be used to chill a serving tray for foods best served at reduced temperatures relative to their surrounding environment.

Although described above primarily in the context of thermoelectric cooling, it is conceived that the cooling module may be able to make use of a compression or absorption based cooling system having its cold end exposed to the exterior of the module through the top or bottom panel and its hot end dumping heat to air discharged through an end panel.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A cooling module comprising:

a casing having top, bottom and side walls and opposing front and rear end faces defining an interior of the casing, the interior of the casing being divided to define a first chamber and a second chamber;

a cooling system supported within the casing and having a hot end disposed in the first chamber and a cold end disposed in the second chamber, the front face of the casing having both inlet and discharge openings formed therein at the first chamber, the inlet and discharge openings facing away from the casing in a common direction at the front face thereof to communicate the first chamber with the exterior of the casing at only a front end of the casing, and the cold end in the second chamber being exposed to an exterior of the casing at one of the top and bottom walls; and a fan supported within the first chamber and arranged to discharge air therefrom through the discharge openings in the front face after entry of the air into the first chamber through the inlet openings in the front face and heating of the air in the first chamber by the hot end of the cooling system.

2. The cooling module according to claim 1 wherein the cooling system comprises a thermo-electric cooling cell defining the hot end and cold end.

3. The cooling module according to claim 2 wherein the hot end of the cooling system comprises a heat dispersing member and the cold end of the cooling system comprises a cool transmitting member.

4. The cooling module according to claim 1 wherein the first and second chambers respectively define bottom and top chambers adjacent the top and bottom walls of the casing respectively, the hot and cold ends being disposed in opposite ones of the top and bottom chambers.

5. The cooling module according to claim 1 wherein a channel is defined within the casing to extend from the inlet openings to the discharge openings with the hot end and fan disposed in the channel to direct air entering the channel through the inlet openings past the hot end to the discharge openings.

6. The cooling module according to claim 1 in combination with a cabinet, the cabinet being formed of insulated panels including a top cabinet wall, a bottom cabinet wall, side cabinet walls and a rear cabinet wall connected to define an open front and a front door connected to the cabinet and movable between an open position exposing the open front and a closed position at least partly covering the open front, wherein the cooling module is slidable into the cabinet through the open front face to allow cooling to be provided within the cabinet by the cold end of the cooling system.

7. The combination according to claim 6 wherein the front door is arranged to, when in the closed position, define a slot shaped opening portion of the open front below a front face of the door and the casing is located at the bottom of the cabinet with the cold end exposed to the exterior of the casing at the top wall thereof and with the inlet and discharge openings aligned with the opening portion.

8. The combination according to claim 6 wherein the front door is arranged to, when in the closed position, define a slot shaped opening portion of the open front above a front face of the door and the casing is located at the top of the cabinet with the cold end exposed to the exterior of the housing at the bottom wall thereof and with the discharge openings aligned with the opening portion.

9. The combination according to claim 6 wherein the side cabinet walls have rails located for mounting the cooling module at a top or the bottom of the cabinet as selected by a user.

10. The combination according to claim 6 wherein the panels are formed from a laminate defined by a layer of an insulating foam material and an exterior cladding material.

11. The combination according to claim 10 wherein at least some of the panels are supplied as a flat continuous sheet of the laminate which can be bent to form corners and define the panels.

12. The combination according to claim 11 wherein the insulating foam material is cut away into a 90 degree angle along an intended bend line at which the sheet can be bent to form a respective corner and the panels remain connected by the exterior cladding bent at the corner.

13. The combination according to claim 10 wherein the insulating foam layer of the laminate carries, at those portions thereof defining the side cabinet walls, slide rails.

14. A refrigerated cabinet in combination with a cooling module for insertion into the refrigerated cabinet, the refrigerated cabinet comprising:

a cabinet formed of insulated panels including a top cabinet wall, a bottom cabinet wall, side cabinet walls and a rear cabinet wall connected to define an open front; and a front door connected to the cabinet and movable between an open position exposing the open front and a closed position at least partly covering the open front;

and the cooling module comprising:

a casing defining a top wall, a bottom wall and two side walls; and a cooling system having a hot end and a cold end and a fan supported within the casing for discharging heated air from the hot end, the cold end being exposed to an exterior of the casing at the top or bottom wall thereof and a front face of the casing having inlet and discharge openings to facilitate movement of air past the hot end of the cooling system for discharge of the heated air through the open front of the cabinet;

wherein the panels are formed from a laminate defined by a layer of an insulating foam material and an exterior cladding material; and wherein the panels are supplied as a flat continuous sheet of the laminate which can be bent to form corners and define the top cabinet wall, bottom cabinet wall, side cabinet walls and rear cabinet wall.

15. The combination according to claim 14 wherein the insulating foam material is cut away into a 90 degree angle along an intended bend line at which the flat continuous sheet of the laminate can be bent to form a respective corner and the cabinet walls remain connected by the exterior cladding bent at the corner.

16. The combination according to claim 14 wherein the cooling system comprises a thermo-electric cooling cell defining the hot end and cold end.

17. The combination according to claim 14 wherein an additional fan is supported within the casing for moving air within the cabinet past the cold end of the cooling system.

18. The combination according to claim 14 wherein the front door is arranged to, when in the closed position, define a slot shaped opening portion of the open front below a front face of the door and the casing is located at the bottom of the cabinet with the cold end exposed to the exterior of the casing at the top wall thereof and with the inlet and discharge openings aligned with the opening portion.

19. The combination according to claim 14 wherein the front door is arranged to, when in the closed position, define a slot shaped opening portion of the open front above a front face of the door and the casing is located at the top of the cabinet with the cold end exposed to the exterior of the housing at the bottom wall thereof and with the discharge openings aligned with the opening portion.

* * * * *